United States Patent [19]

Oka et al.

[11] 4,420,366

[45] Dec. 13, 1983

[54] METHOD FOR MANUFACTURING SHADOW MASK

[75] Inventors: Koichiro Oka; Hiroshi Tanaka; Makoto Harigae, all of Fukaya, Japan

[73] Assignee: Tokyo Shibaura Denki Kabushiki Kaisha, Kawasaki, Japan

[21] Appl. No.: 478,544

[22] Filed: Mar. 24, 1983

[30] Foreign Application Priority Data

Mar. 29, 1982 [JP] Japan ..... 57-48974

[51] Int. Cl.[3] ..... C23F 1/02

[52] U.S. Cl. ..... 156/644; 156/659.1; 252/79.2

[58] Field of Search ..... 156/644, 654, 659.1, 156/661.1; 252/79.2; 430/23, 313, 318

[56] References Cited

U.S. PATENT DOCUMENTS 2,684,892 7/1954 Saulnier ..... 156/644 X 3,824,136 7/1974 Gilbert ..... 156/644

*Primary Examiner*—William A. Powell

*Attorney, Agent, or Firm*—Cushman, Darby & Cushman

[57] ABSTRACT

A method for manufacturing a shadow mask by spraying an Fe-Ni alloy sheet with a ferric chloride solution to form apertures for passing an electron beam the ferric chloride solution is controlled to have 0.30±0.20% by weight of free hydrochloric acid within a ferric chloride solution temperature range between 40° C. and 70° C., to have a total amount of $Fe^{++}$ ions and $Ni^{++}$ ions of not more than 15% by weight, and to have a specific gravity which falls within a region bounded between a curve plotted according to a relation $1.461-(4.63\times10^{-4}T)-(1.96\times10^{-6}\times T^2)$ (where T is a ferric chloride solution temperature) and a curve plotted according to a relation $1.552+(7.79\times10^{-5}\times T)-(1.18\times10^{-5}\times T^2)$.

3 Claims, 4 Drawing Figures

METHOD FOR MANUFACTURING SHADOW MASK

BACKGROUND OF THE INVENTION

The present invention relates to a method for manufacturing a shadow mask, comprising spraying a sheet for a shadow mask with an etching solution so as to form apertures which allow an electron beam to pass therethrough.

Conventionally, a mild steel plate has been used as a shadow mask mounted in a color cathode ray tube. In a shadow mask mounted in a color cathode ray tube which requires a high definition and high resolution display, the diameter and pitch of the electron beam apertures must be made very small with high precision. For example, in a shadow mask having circular apertures for passing the electron beams therethrough, the pitch is 0.2 mm, and the aperture diameter on the side of the electron gun is about 0.10 mm.

The most important function of a shadow mask for a color cathode ray tube is to transmit an electron beam through apertures in the shadow mask and to radiate correctly the electron beam onto predetermined positions of a phosphor screen. However, during operation the shadow mask expands due to heat from the electron beams radiated from the electron gun. As a result, the electron beam is not be radiated correctly onto the predetermined positions of the phosphor screen, resulting in so-called mislanding and hence poor color purity.

This leads to a decisive drawback in the color cathode ray tube. Since invar steel has a very low linear expansion coefficient, it may be used to solve the above problem. Invar steel is a nickel steel material and has a general composition of 0.20% or less of carbon, 0.5% of manganese, 36% of nickel and the remainder of iron. Invar steel has a very low linear expansion coefficient of about $1\times10^{-6}$/deg in a temperature range of 0° to 40° C. This linear expansion coefficient is about one-tenth of that of mild steel.

In general, an etching solution of ferric chloride is sprayed onto a sheet of an alloy (e.g., invar steel) containing iron and nickel as the major components to form an aperture for passing the electron beam therethrough. In this case, when free hydrochloric acid in a solution of ferric chloride exceeds a predetermined range, the etching resistance of the photoresist film formed on a nonetching portion is degraded, so that an undesired portion is etched. However, when an amount of free hydrochloric acid in the solution of ferric chloride is below the predetermined range, nickel hydroxide and iron hydroxide are produced, and are precipitated and deposited on the etched portion. As shown in FIG. 1 a zigzag pattern 2 occurs in a portion of an edge shape which defines an aperture 1. The size of the aperture then varies and cannot be precisely and uniformly controlled, resulting in a nonuniform screen of the color cathode ray tube.

When the numbers of $Fe^{++}$ ions and $Ni^{++}$ ions which do not contribute to an etching reaction increases in the solution of ferric chloride to where they exceed a predetermined range, an exchange speed of etching ions ($Fe^{+++}$ ions) at an etching interface varies and cannot be controlled. Furthermore, a zigzag pattern is formed in a portion of an edge shape which defines an aperture, as shown in FIG. 1. The size of the aperture varies in the same manner as when there is too little hydrochloric acid.

When a temperature of the ferric chloride solution is lowered to a predetermined temperature, the etching property of the solution is degraded. However, when the temperature of the solution exceeds the predetermined temperature range, the etching resistance of the photoresist film is degraded due to swelling, and an undesired portion of the plate is etched.

There is a correlation between a solution temperature and its specific gravity. In general, when the specific gravity of the solution is too low, or the temperature too high, its viscosity decreases. In etching of the Fe-Ni alloy, when etching ions have a constant diffusion rate, the etching rate increases greatly. As a result, especially in a polycrystalline Fe-Ni alloy having various crystal planes, the surface which tends to be dissolved is etched first. The portion of the plate which defines the aperture for passing an electron beam therethrough has a zigzag pattern, as shown in FIG. 1. Highly precise dimensioning of the aperture cannot be performed as in the case of too little free hydrochloric acid. On the other hand, when the specific gravity of the solution is too high, or the temperature too low its viscosity increases too much, and the mobility of etching ions is restricted. The etching rate is then lowered, which is not desirable in mass production. As a result, the ranges of temperature and specific gravity must be determined from the viewpoint of mass production of the shadow mask versus quality.

SUMMARY OF THE INVENTION

It is an object of the present invention to provide a method for manufacturing a shadow mask so as to form accurate, uniform apertures of a shadow mask.

In order to achieve the above object, there is provided a method for manufacturing a shadow mask by spraying an Fe-Ni alloy sheet with a ferric chloride solution to form an aperture for passing an electron beam therethrough, wherein the ferric chloride solution is controlled to have a content of 0.30±0.20% by weight of free hydrochloric acid within a ferric chloride solution temperature range between 40° C. and 70° C., to have a total amount of $Fe^{++}$ ions and $Ni^{++}$ ions of not more than 15% by weight, and to have a specific gravity which falls within a region bounded between a curve plotted according to a relation $1.461-(4.63\times10^{-4}\times T)-(1.96\times10^{-6}\times T^2)$ (where T is a ferric chloride solution temperature) and a curve plotted according to a relation $1.552+(7.79\times10^{-5}\times T)-(1.18\times10^{-5}\times T^2)$. According to the present invention, the Fe-Ni alloy sheet is preferably made of invar steel.

DETAILED DESCRIPTION OF THE PREFERRED EMBODIMENT

Figure 1:
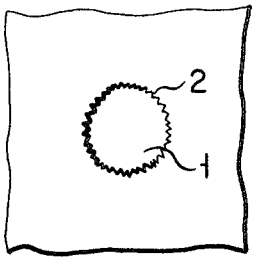
FIG. 1 is a plan view showing a edge shape of an aperture formed in a shadow mask according to a conventional method.
Figure 2:
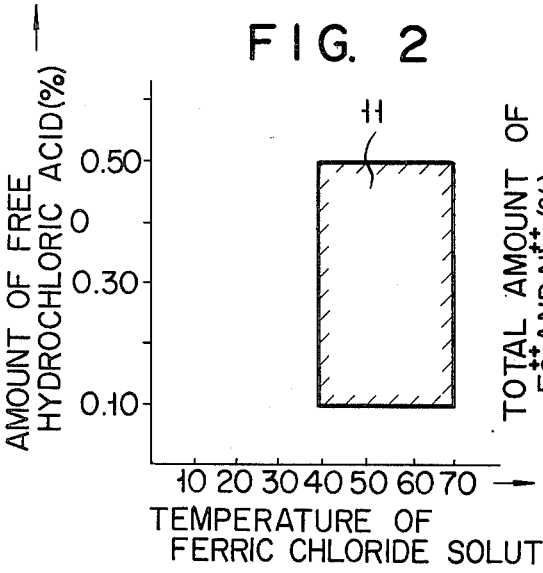
FIG. 2 is a graph showing the relationship between a temperature of a ferric chloride solution and an amount of free hydrochloric acid.

Various types of ferric chloride solutions were prepared. These ferric chloride solutions were respectively sprayed onto invar steel sheets for forming shadow masks, to form apertures therein for passing electron beams therethrough. Using a test method for examining the shape of the aperture and the condition of a photoresist film, a safe range in a relationship between a temperature of a ferric chloride solution and an amount of free hydrochloric acid was determined. Results are shown in FIG. 2. When the ferric chloride solution was kept at a temperature range between 40° C. and 70° C., safe range 11 was found wherein free hydrochloric acid falls within a range of 0.30 ±0.20% by weight (i.e., ranges between 0.10% by weight and 0.50% by weight). It was found that a more preferable safe range was 0.3±0.1% by weight. When the amount of free hydrochloric acid fell within this safe range, it was found that the photoresist film was not etched, the shape of each aperture was circular, and variations in aperture shape were very small. As a result, it is expected that a uniform screen of the color cathode ray tube can be obtained.

Figure 3:
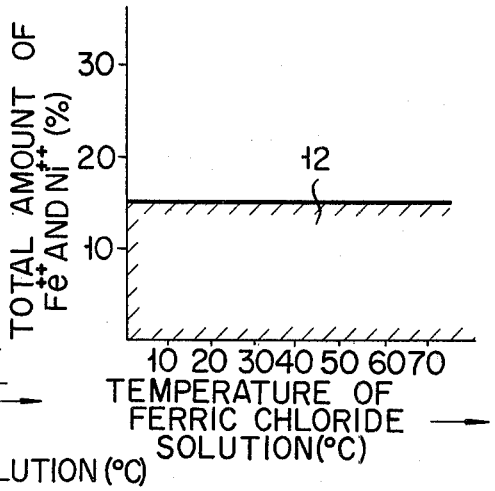
FIG. 3 is a graph showing the relationship between the temperature of the ferric chloride solution and the total amount of $Fe^{++}$ and $Ni^{++}$ ions.

In the same test method as described above, the relationship between the temperature of the ferric chloride solution and a total amount of $Fe^{++}$ and $Ni^{++}$ ions was examined. It was found that an optimum safe range 12 in FIG. 3 corresponded to a total amount of $Fe^{++}$ and $Ni^{++}$ ions of not more than 15% by weight. Since the total amount of $Fe^{++}$ and $Ni^{++}$ ions was kept within the above range, an etching rate was properly controlled, and the aperture shape was substantially circular.

Figure 4:
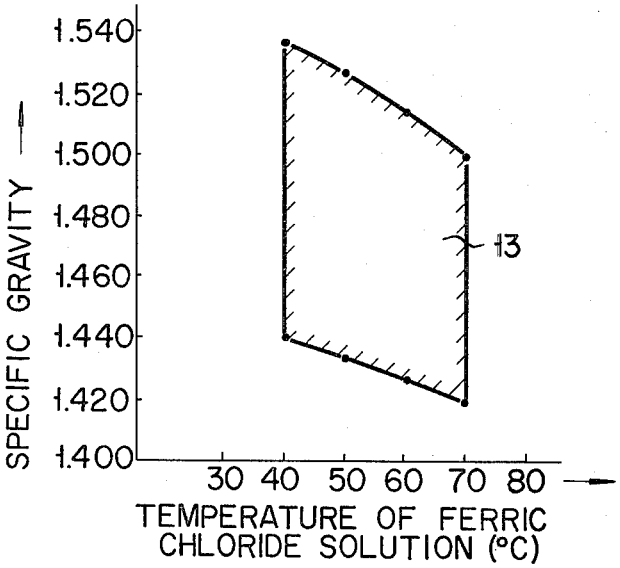
FIG. 4 is a graph showing the relationship between the temperature of the ferric chloride solution and its specific gravity.

In the same test method as described above, the relationship between the temperature of the ferric chloride solution and its specific gravity was determined. When the solution temperature was kept in a safe range in FIG. 4 (i.e., the range between 40° C. and 70° C.), it was found that the specific gravity of the solution fell within a region bounded by a curve plotted according to a relation $1.461-(4.63\times10^{-4}\times T)-(1.96\times10^{-6}\times T^2)$ (where T was the temperature of the solution) and a curve plotted according to a relation $1.552+(7.79\times10^{-5}\times T)-(1.18\times10^{-5}\times T^2)$. It was found under this assumption that the etching resistance of the photoresist film was not degraded and the etching rate of the etching solution did not decrease. Furthermore, it was also found that the aperture shape was circular and control of aperture size was easily performed.

What we claim is:

1. A method for manufacturing a shadow mask by spraying an Fe-Ni alloy sheet with a ferric chloride solution to form an aperture for passing an electron beam therethrough, wherein the ferric chloride solution is controlled to have a content of 0.30±0.20% by weight of free hydrochloric acid within a ferric chloride solution temperature range between 40° C. and 70° C., to have a total amount of $Fe^{++}$ ions and $Ni^{++}$ ions of not more than 15% by weight, and to have a specific gravity which falls within a region bounded between a curve plotted according to a relation $1.461-(4.63\times10^{-4}\times T)-(1.96\times10^{-6}\times T^2)$ (where T is a ferric chloride solution temperature) and a curve plotted according to a relation $1.552+(7.79\times10^{-5}\times T)-(1.18\times10^{-5}\times T^2)$.

2. A method according to claim 1, wherein the content of free hydrochloric acid is 0.30±0.10% by weight within the ferric chloride solution temperature range between 40° C. and 70° C.

3. A method according to claim 1, wherein the Fe-Ni alloy comprises invar steel.

* * * * *